US010100712B2

(12) United States Patent
Baldus et al.

(10) Patent No.: US 10,100,712 B2
(45) Date of Patent: Oct. 16, 2018

(54) GROUND MILLING MACHINE HAVING A COOLING SYSTEM, COOLING SYSTEM, AND METHOD FOR COOLING A GROUND MILLING MACHINE

(71) Applicant: BOMAG GmbH, Boppard (DE)

(72) Inventors: Matthias Baldus, Marienhausen (DE); Diana Stein, Andernach (DE); Manfred Hammes, Emmelshausen (DE); Nils Muders, Damscheid (DE)

(73) Assignee: BOMAG GmbH, Boppard (DE)

( * ) Notice: Subject to any disclaimer, the term of this patent is extended or adjusted under 35 U.S.C. 154(b) by 345 days.

(21) Appl. No.: 14/737,557

(22) Filed: Jun. 12, 2015

(65) Prior Publication Data

US 2015/0361866 A1 Dec. 17, 2015

(30) Foreign Application Priority Data

Jun. 12, 2014 (DE) ..... 10 2014 008 749

(51) Int. Cl.

| | |
|---|---|
| ***B60K 11/00*** | (2006.01) |
| ***F01P 11/10*** | (2006.01) |
| ***E01C 23/088*** | (2006.01) |
| *F01P 3/18* | (2006.01) |
| *F01P 5/02* | (2006.01) |

(52) U.S. Cl.

CPC ..... *F01P 11/10* (2013.01); *E01C 23/088* (2013.01); *F01P 2003/185* (2013.01); *F01P 2005/025* (2013.01)

(58) Field of Classification Search

CPC .... F01P 11/10; F01P 11/12; F01P 5/06; F01P 5/00; F01P 5/02; F01P 2005/025; F01P 2003/182; F01P 2003/185; B60K 11/00; B60K 11/02; B60K 11/04; B60K 11/06; B60K 11/08; E01C 23/088; E01C 23/08

See application file for complete search history.

(56) References Cited

U.S. PATENT DOCUMENTS

| | | | | | |
|---|---|---|---|---|---|
| 4,339,014 | A * | 7/1982 | Berth | B60K 11/08 | 180/68.1 |
| 4,747,858 | A * | 5/1988 | Gottier | F25J 3/0209 | 62/632 |
| 5,373,892 | A * | 12/1994 | Johnson | B60H 1/00378 | 165/41 |
| 6,871,697 | B2 * | 3/2005 | Albright | E02F 9/0883 | 123/41.49 |
| 7,040,837 | B2 * | 5/2006 | Gaertner | B60K 11/08 | 123/41.49 |
| 7,134,518 | B2 * | 11/2006 | Arai | B60K 11/04 | 180/68.1 |
| 7,325,518 | B2 * | 2/2008 | Bering | F01P 5/06 | 123/41.01 |

(Continued)

FOREIGN PATENT DOCUMENTS

| | | |
|---|---|---|
| DE | 103 47 872 B3 | 4/2005 |
| DE | 10 2011 005 275 A1 | 9/2012 |

*Primary Examiner* — James M Dolak

(74) *Attorney, Agent, or Firm* — Wood Herron & Evans LLP

(57) ABSTRACT

The present invention relates to a ground milling machine with two cooling ducts, which allow a mutually separated guidance of cooling air. The present invention further relates to such a cooling system and a method for cooling a ground milling machine.

31 Claims, 5 Drawing Sheets

(56) References Cited

U.S. PATENT DOCUMENTS

| | | | | |
|---|---|---|---|---|
| 7,753,142 | B2 * | 7/2010 | Jacobsson | B60K 11/04 173/27 |
| 7,997,238 | B2 * | 8/2011 | D'hondt | A01D 41/1252 123/195 C |
| 8,453,777 | B2 * | 6/2013 | Farlow | F04D 17/16 180/68.1 |
| 8,567,356 | B2 * | 10/2013 | Jacobsson | F01P 7/04 123/41.08 |
| 8,590,650 | B2 * | 11/2013 | Schertz | F28F 27/00 123/41.49 |
| 8,936,122 | B2 * | 1/2015 | MacGregor | B60K 11/04 180/68.1 |
| 9,810,135 | B2 * | 11/2017 | Ishikawa | F04D 29/667 |
| 9,822,736 | B2 * | 11/2017 | Roehr | E01C 19/26 |
| 9,863,247 | B2 * | 1/2018 | Von der Lippe | E01C 23/088 |
| 2013/0305717 | A1 | 11/2013 | Roehr et al. | |

* cited by examiner

GROUND MILLING MACHINE HAVING A COOLING SYSTEM, COOLING SYSTEM, AND METHOD FOR COOLING A GROUND MILLING MACHINE

CROSS-REFERENCE TO RELATED APPLICATION

The present application claims priority under 35 U.S.C. § 119 of German Patent Application No. 10 2014 008 749.2, filed Jun. 12, 2014, the disclosure of which is hereby incorporated herein by reference in its entirety.

FIELD OF THE INVENTION

The present invention relates to a ground milling machine, especially a cold milling machine, a stabiliser or recycler, a cooling system, and a method for cooling such a ground milling machine.

BACKGROUND OF THE INVENTION

A generic ground milling machine, especially a cold milling machine, a stabiliser or recycler, having a cooling system is known, for example, from DE 103 47 872 C5. Such ground milling machines are frequently used in road and path construction as well as for subgrade stabilisation. Their working device is a cylindrically shaped milling drum which is equipped on its outside circumference with a plurality of milling tools. In working operation of the ground milling machine, the milling drum is made to rotate and the milling tools arranged on the milling drum are driven into the ground, for example, a road surface. The ground or asphalt layer of a road to be processed is thus broken up and crushed. The produced milling material is usually conveyed by a discharge conveyor either in or against the working direction of the ground milling machine to a transport vehicle and is removed by said vehicle.

Generic ground milling machines typically comprise an internal combustion engine as a drive unit, for example, a diesel engine, which is arranged in an engine compartment. The engine compartment designates a substantially enclosed arrangement compartment of the ground milling machine, in the interior space of which the internal combustion engine is arranged. The internal combustion engine is used on the one hand to rotate the milling drum in working operation of the ground milling machine via a milling gear which is mechanical, for example. On the other hand, the internal combustion engine provides the drive power required for travelling operation, for example, by driving a pump transfer gear, which on its part supplies a hydraulic system with at least one hydraulic pump with power. The hydraulic system drives the running gear among other things, for example, specifically the wheels or crawler tracks. The pump transfer gear thus concerns a functional unit for power splitting, via which the drive motion of the internal combustion engine, for example, of its crankshaft, can be distributed to several consumers, especially the hydraulic pumps. Such pump transfer gears frequently constitute a structural unit.

Considerable heating phenomena occur during the operation of such soil milling machines, for example, obviously, at the internal combustion engine, in the hydraulic circuit, etc. Ground milling machines therefore typically comprise a cooling system with an engine cooling device and a hydraulic fluid cooling device. The engine cooling device comprises a first fan, for example, and a cooling circuit with an engine heat exchanger. A cooling liquid is circulated in said cooling circuit, for example, via which the internal combustion engine can be cooled in operation. The heat absorbed by the cooling liquid is dissipated at the heat exchanger to the air. The hydraulic fluid cooling device is implemented in such a way that it enables a cooling of the hydraulic fluid that is heated up during operation. The hydraulic fluid cooling device is frequently arranged in such a manner that it uses cooling air of the engine cooling device for cooling purposes.

It is known for such ground milling machines that a first cooling air duct is present, which is formed in such a manner that cooling air aspirated from the outside environment by the first fan is guided to the engine heat exchanger and subsequently to a first cooling air outlet. The cooling air guided in the first cooling air duct can further be guided through a hydraulic fluid cooling device. However, this partly considerably reduces the total cooling power of the cooling system, since, in this case, only cooling air that has already been heated to some extent is available for the hydraulic fluid heat exchanger, for example. For this reason, it is known from the prior art to use considerably oversized fans in order to provide the entire required cooling air for the engine cooling device and the hydraulic fluid cooling device. This leads to a high power demand of the fan and thus especially also to a comparatively high share in the fuel consumption which is incurred for the operation of the fan alone.

A method for cooling the internal combustion engine arranged in an engine compartment and the hydraulic system of a ground milling machine comprises the intake of cooling air in a first cooling air duct by a first fan, for example. The cooling air of the first cooling air duct is conducted in the prior art through an engine cooling device with an engine heat exchanger, and, thereafter or before, through a heat exchanger of a hydraulic fluid cooling device. The cooling air is then ejected through a cooling air outlet. A fluid such as cooling water or hydraulic oil flows through the heat exchangers, which are arranged in such a way that they have the greatest possible surface over which the cooling air can be conducted in order to transfer waste heat from the fluid to the cooling air and to remove said heat. It is the object of the cooling air to convey waste heat from the ground milling machine to the ambient environment. The waste heat originates from the internal combustion engine, for example, which also frequently heats the cooling water of a cooling circuit via a heat exchanger. This basic configuration of cooling circuits, both for the internal combustion engine and also for the hydraulic system, is known from the prior art.

In the ground milling machines and methods for cooling as known from the prior art and as described above, it is disadvantageous that oversized cooling devices are regularly used in order to ensure efficient cooling both of the internal combustion engine and also the hydraulic fluid even under peak loads. Furthermore, already heated cooling air is partly used for further cooling, resulting in a higher fan power being necessary for achieving the desired cooling power.

It is the object of the present invention to solve the problems of the prior art. It is specifically the object of the present invention to provide a ground milling machine with a cooling system, such a cooling system and a method for cooling a ground milling machine which enable an especially efficient, reliable and at the same time energy-saving cooling.

SUMMARY OF THE INVENTION

For a generic ground milling machine, the object is achieved specifically in that the hydraulic fluid cooling device comprises a second fan and a hydraulic fluid heat exchanger, that a second cooling air duct is present which is implemented in such a manner that cooling air aspirated from the ambient environment by the second fan is guided to the hydraulic fluid heat exchanger and subsequently to a second cooling air outlet, and that the first cooling air duct and the second cooling air duct are implemented so as to conduct the cooling air of the first cooling air duct and the cooling air of the second cooling air duct, separately from each other and by circumventing the engine compartment, through the engine cooling device and the hydraulic fluid cooling device. It is thus a basic concept of the present invention that the cooling air supply and guidance for the engine cooling device and for the hydraulic fluid cooling device are spatially separated and occur functionally substantially independently from each other, thus enabling individual and situationally adequate cooling air supply for the engine cooling device and for the hydraulic fluid cooling device.

Greatly varying load states occur in the hydraulic system and the internal combustion engine especially in the case of ground milling machines in working operation and in travelling operation. The working operation of the ground milling machine designates the operating mode in which the ground milling machine travels at a relatively slow but substantially constant velocity and mills the ground surface with a rotating milling drum. No ground is milled in travelling operation, on the other hand, in which the milling drum is idle and the ground milling machine is moved at a relatively high speed in comparison to working operation, for example, in order to transport the machine between different working sites. Travelling operation is thus mainly used for driving the ground milling machine to a working site, to a maintenance position, to a transport location, etc., whereas the working operation, even when the ground milling machine travels slowly, is used primarily for working operation of the ground milling machine for milling the ground surface. The travelling devices of generic ground milling machines usually concern travelling devices which are driven by individual hydraulic motors. The hydraulic system is thus heavily loaded in travelling operation of the ground milling machine, whereas the internal combustion engine, which is configured for the operation of the milling drum, is loaded to an only relatively low extent.

In working operation, on the other hand, the ground milling machine travels comparatively slowly and neither needs to accelerate or brake strongly, as a result of which the hydraulic system of the running gears is loaded to a relatively low extent. In contrast, the milling drum needs to be rotated and held in working operation against the resistance of the ground to be processed. The internal combustion engine is thus loaded heavily.

As a result of the different loads in working and travelling operation of the ground milling machine, the hydraulic oil of the hydraulic system and the cooling liquid of the internal combustion engine are heated to different extents in frequently different time intervals, especially in alternation, even though this occurs independently from each other. Specifically, strong heating of the cooling liquid of the internal combustion engine occurs in working operation, whereas the hydraulic oil of the hydraulic system is then only heated to a relatively low extent. In travelling operation, on the other hand, the hydraulic oil of the hydraulic system is heated strongly, whereas the cooling liquid of the internal combustion engine is then only heated to a relatively low extent.

The present invention now makes use of this fact for optimising the cooling system. In contrast to the prior art, according to which the cooling system of a generic ground milling machine is frequently operated continuously with full load as a precaution in order to sufficiently cool the respectively loaded component of the ground milling machine, the present invention now provides mutually independent and needs-oriented control of the engine cooling device independently of the hydraulic fluid cooling device.

It is a further basic concept of the present invention that the cooling air is not guided or flows past the internal combustion engine in such a way that it is heated thereby before it arrives at the engine heat exchanger and/or the hydraulic fluid heat exchanger. Instead, the cooling air guidance is rather implemented according to the present invention in such a manner that it is not only mutually separated, but it also circumvents the engine compartment. It is thus ensured that "fresh" cooling air will always reach the engine heat exchanger and the hydraulic fluid heat exchanger, respectively, and the best possible cooling power is achieved there. A more efficient cooling with lower power consumption is already enabled by merely circumventing the engine compartment or the internal combustion engine of the ground milling machine. Cooling air here refers to air which is aspirated from the ambient environment, enters the first and second cooling air ducts and is guided by them to the engine cooling device and the hydraulic fluid cooling device, respectively. The cooling air is guided through the ground milling machine in such a way that it does not absorb any, or hardly any, waste heat of the internal combustion engine directly therefrom. Waste heat of the internal combustion engine is thus substantially only absorbed via the cooling circuit with cooling liquid for the internal combustion engine by the engine heat exchanger. Air that is situated in the engine compartment of the internal combustion engine or is transported through said compartment and is heated directly by the internal combustion engine is designated, in this case, as engine air for the purpose of distinguishing said air from cooling air.

The entire cooling air guide path extends from the ambient environment into the interior of the ground milling machine, through the heat exchangers and back to the ambient environment. The two cooling air ducts of the cooling air guide path are the sections of said cooling air guide path which receive the cooling air coming from the ambient environment and conduct two mutually separate cooling air flows to the engine heat exchanger on the one hand and to the hydraulic fluid heat exchanger on the other hand. It is important in this respect that the cooling air flows are conducted within the cooling air ducts in a spatially separate manner and no cooling air of one respective cooling air duct is mixed with cooling air of the respectively other cooling air duct within the respective cooling air duct. On the other hand, there can be a common entrance region of the cooling air into the ground milling machine, from which the two cooling air ducts then branch off. A common discharge air space can also be provided, into which both cooling air ducts open before the cooling air is conducted back into the ambient environment. The cooling air duct thus designates in the present case a section of the cooling air guide path and respectively commences at a cooling air duct inlet from which cooling air is guided within the cooling air system separate from the cooling air of the other cooling air duct. As a result, two mutually separate cooling air flows are available in the cooling system, which are guided separately from each other to the engine heat exchanger and the hydraulic fluid heat exchanger. The cooling air ducts end at the point of the cooling air guide path, as regarded in the direction of flow of the cooling air, where the cooling air has passed both the respective heat exchanger and the first or second fan. The arrangement of the respective heat exchanger and the respective fan can vary, depending on whether the fan aspirates the cooling air through the heat exchanger (arrangement of the fan in the direction of flow of the cooling air behind the respective heat exchanger) or presses said air (arrangement of the fan in the direction of flow of the cooling air before the respective heat exchanger).

It is thus a basic concept of the present invention that the first cooling air duct and the second cooling air duct respectively conduct a cooling air flow separate from each other, so that said cooling air flows respectively either only flow through the engine cooling device, especially the engine heat exchanger and the first fan, or through the hydraulic fluid cooling device, especially the hydraulic fluid heat exchanger and the second fan. It is, also, a core element of the present invention that the cooling air which is conveyed through the first and the second cooling air duct circumvents the engine compartment, i.e., it is not guided through the engine compartment and is thus not conducted past the internal combustion engine.

The first and the second cooling air duct as well as the engine cooling device and the hydraulic fluid cooling device can principally be arranged independently from each other at almost any desired position in the ground milling machine. In order to achieve the most compact configuration and easy mounting and maintenance, it is advantageous, however, if the cooling system is arranged in such a way that the engine heat exchanger and the first fan are arranged adjacent to the hydraulic fluid heat exchanger and the second fan, especially transversely to the working direction of the ground milling machine. The working direction designates the direction in which the ground milling machine travels during the milling of the ground surface, i.e., the forward direction. A package-like arrangement structure is thus obtained, which enables easy mounting and especially also easy maintenance. An especially compact configuration is achieved by a common, mutually adjacent arrangement of the engine heat exchanger with the first fan and the hydraulic fluid heat exchanger with the second fan, in which the aforementioned components can optionally even be produced as a contiguous module and can be mounted in an integral manner.

An especially compact design of the cooling system according to the present invention can further be obtained if the first cooling air duct and the second cooling air duct are arranged in such a manner that they guide the cooling air aspirated by the respective first and second fans in parallel with respect to each other. In other words, the first and the second cooling air ducts are arranged in such a way that the cooling air flows respectively guided by them have the same or a diametrically opposite direction of flow. This allows for virtually uniform configuration of the cooling air ducts and a space-saving arrangement within the ground milling machine. The practical implementation has shown that especially a cooling air guidance by the first and the second cooling air ducts in or against the working direction, i.e., in the longitudinal direction of the ground milling machine, is especially advantageous. The soil milling machine can thus be kept comparatively narrow, which is especially advantageous with respect to the transport width limitations for such machines. It is also preferable if the cooling air in the first and the second cooling air duct flows adjacent to each other and in the same direction.

Even if the cooling air is not conducted through the engine compartment, it is advantageous from a constructional standpoint to arrange the first and/or the second cooling air duct adjacent to the engine compartment, especially directly behind said compartment in the working direction. This is achieved, for example, in that at least one duct wall of the first and/or second cooling air duct is also a wall of the engine compartment. The engine compartment is spatially separated in this embodiment from the first and/or second cooling air duct by a first separating wall, for example. Said first separating wall, which is formed as a bulkhead plate, for example, preferably at the same time forms a part of the first and/or second cooling air duct and prevents the cooling air from coming into contact with the engine air. Both the first cooling air duct and also the second cooling air duct can respectively comprise a separate first separating wall, which separates them from the engine compartment, or a common first separating wall is present which is a part both of the first and also the second cooling air duct. The first and/or the second cooling air duct are thus arranged in this alternative embodiment in such a way that they conduct their respective cooling air flows at least partly along the engine compartment or past said compartment, wherein the cooling air of the respective cooling air flows is separated with respect to flow and spatially by the first separating wall from the engine compartment and the engine air situated therein. As a result of this arrangement of the cooling air ducts, the compact configuration of the cooling system is promoted and further advantages are enabled, which will be discussed below in closer detail.

Further, the cooling system can additionally or alternatively be formed in an especially compact manner when the first cooling air duct and the second cooling air duct are arranged directly adjacent to each other and are spatially separated from each other via a second separating wall, e.g., a second bulkhead plate. The first and the second cooling air ducts are thus directly adjacent to each other via the second separating wall, and the second separating wall is thus part of the first cooling air duct and also the second cooling air duct and prevents that the cooling air flows of the respective ducts mix with each other. The second separating wall ensures the separation of the cooling air flows of the first and second cooling air ducts according to the present invention.

The second separating wall is preferably arranged directly adjacent and perpendicularly to the first separating wall, and is, in particular, fixed thereto.

Cooling air is guided via the first cooling air duct from the ambient environment to the engine heat exchanger, via which the engine cooling is substantially achieved. It has been recognized, however, that ventilation of the engine compartment at least to a limited extent can be advantageous, especially when the internal combustion engine is subject to high loads over longer periods of time such as in milling operation, for example. An adequate and especially elegant ventilation of the engine compartment is achieved according to the present invention in that a passage opening is provided for the ventilation of the engine compartment between the engine compartment and the second cooling air duct, especially in the first separating wall separating the second cooling air duct from the engine compartment, through which the heated engine air can flow from the engine compartment to the second cooling air duct, i.e., to the hydraulic cooler side. Engine air thus designates the air externally surrounding the internal combustion engine, which air is heated by the internal combustion engine during the operation thereof. The hydraulic cooler side of the first separating wall is the section of the first separating wall which is a part of the second cooling air duct and delimits said duct towards the engine compartment. The at least one passage opening thus connects the engine compartment to the second cooling air duct and thus enables air flow between said two spaces. Either an excess pressure or a negative pressure is set in the second cooling air duct by the second fan, depending at which end of the cooling air duct the fan is arranged and in which direction it conveys the cooling air. It is thus possible, for example, that as a result of the excess pressure in the second cooling air duct the cooling air is pressed through the at least one passage opening into the engine compartment and engine air heated there is displaced through a separate outlet, for example, thus leading to cooling of the internal combustion engine. It is preferable, however, if the second cooling air duct substantially extends to the intake side of the second fan, and the second fan is arranged and operated in such a way that cooling air is aspirated by said fan through the hydraulic fluid heat exchanger. As a result of this arrangement, engine air is aspirated from the engine compartment into the second cooling air duct and thence removed together with the cooling air originating from the ambient environment. Heated engine air is thus aspirated at least to a limited extent from the engine compartment into the second cooling air duct. The cooling air is still conducted by circumventing the engine compartment to the hydraulic fluid heat exchanger both in case of excess pressure and also negative pressure in the second cooling air duct. A portion of the air flowing into the cooling air duct is introduced into the engine compartment only in the case of excess pressure in the second cooling air duct and displaces the engine air heated there. In the case of negative pressure in the second cooling air duct, both cooling air coming directly from the ambient environment and also engine air are aspirated into the second cooling air duct and conveyed from there past the hydraulic fluid heat exchanger. The arrangement of passage openings between the engine compartment and the second cooling air duct ensures that the hydraulic fluid cooling device supports the engine cooling device, especially during peak loads of the internal combustion engine, by venting the engine compartment. As a result, the first fan of the engine cooling device can be implemented with lower power and thus with an energy-saving configuration. The size of the passage openings or their total opening area is dimensioned such that it is just about large enough that the maximum permissible engine compartment temperature is not exceeded. What is relevant for this embodiment is the finding that the power of the internal combustion engine is relatively low during strong heating of the hydraulic fluid in pure travelling operation of the ground milling machine and thus the heating of the engine air occurs only to a very limited extent, so that the heating of the cooling air by the admixed engine air is very low. The cooling power of the hydraulic fluid cooler is hardly influenced in a disadvantageous manner by the engine air, in this case. On the other hand, the engine air is heated to a relatively great extent in working operation as it is then operated in the high-load range for comparatively long time intervals. In working operation, on the other hand, the heating of the hydraulic fluid is relatively low because the travelling speed of the ground milling machine is low. In this situation, a high cooling power of the hydraulic fluid cooler is thus not necessary, so that the comparatively strong heating of the cooling air by the admixed engine air is also non-critical.

Cooling is especially efficient when the first fan is arranged in the direction of flow of the cooling air behind the engine heat exchanger and/or the second fan is arranged in the direction of flow of the cooling behind the hydraulic fluid heat exchanger. The engine heat exchanger and/or the hydraulic fluid heat exchanger are thus arranged on the intake side of the first or second fan in the direction of flow in the respective cooling air ducts. The cooling air in the first cooling air duct thus firstly passes the cooling air duct inlet of the first cooling air duct, then the engine heat exchanger, and subsequently the first fan and finally leaves the first cooling air duct via the cooling air duct outlet of the first cooling air duct. The cooling air in the second cooling air duct firstly passes the hydraulic fluid heat exchanger after the inlet of the second cooling air duct and then the second fan, and finally leaves the second cooling air duct through the second cooling air duct outlet. This arrangement not only allows achieving an especially effective cooling of the cooling liquid for the internal combustion engine or the hydraulic oil. The arrangement of the first and/or second fan in the direction of flow behind the heat exchangers has also proven to be especially quiet and is thus especially pleasant for the operator of the ground milling machine or for bystanders. The cooling air duct outlet is further defined as the point of the respective cooling air duct where the cooling air leaves the respective cooling air duct, either to the ambient environment or an exhaust air space in which the cooling air flows of the first and the second cooling air duct are joined and are no longer conducted separately from each other. In the most extreme of cases, the cooling air conduit outlet can thus be situated with the rear side of the respective fan or the heat exchanger (depending on the configuration) in the direction of flow of the cooling air.

A special advantage of the present invention comes to bear when the first fan and the second fan are implemented so as to be controllable independently from each other. In other words, the volume flows transported by the respective fans can be set individually, or separately, from each other. This is achieved especially via a control and change in the fan speed. Especially energy-efficient cooling can be achieved with respect to the initially mentioned alternating loads of the internal combustion engine and the hydraulic system in a ground milling machine by a first and second fan which can be controlled independently from each other. Accordingly, the first fan can be operated in working operation with running milling drum of the ground milling machine at high fan speed and thus with a high volume flow and substantially maximum power, whereas the second fan is operated at a relatively low fan speed and thus with a low volume flow or power. In contrast, the second fan can be operated at high fan speed during travelling operation of the ground milling machine and thus at high volume flow and substantially maximum power, whereas the first fan is operated at low fan speed and with lower power. The control of the power of the first fan and the second fan as well as the closed-loop control of the respectively achieved volumetric flow more preferably occurs automatically by a control device depending on an objective control variable, for example, the temperatures of the cooling liquid of the cooling circuit for the internal combustion engine and the hydraulic oil of the hydraulic system. A further control variable may also be the engine compartment temperature which must not exceed a predetermined maximum value. If passage openings are provided between the engine compartment and the second cooling air duct, the control device can also trigger the second fan depending on the temperature of the cooling liquid of the cooling circuit for the internal combustion engine. As a result of the independent adjustment of the fan speeds and thus the volume flow of the cooling air in the first and second cooling air duct, it is ensured that the fans are only operated at high power when this is required for cooling the internal combustion engine or the hydraulic system. The closed-loop control of the fan speeds thus occurs individually and needs-oriented, by means of which the energy consumption of the ground milling machine can be reduced significantly.

In order to achieve an even more individual adjustment of the fan power, it has proven to be advantageous if the hydraulic fluid cooling device comprises a third fan in addition to the second fan, wherein the second fan and third fan are controllable independently from each other. The second fan and the third fan are further ideally arranged considerably smaller with respect to their respective performance specifications than the first fan of the engine cooling device. A more precise closed-loop control can thus be provided especially in the lower power range of the hydraulic fluid cooling device and a total fan power can thus be provided which is adjusted even more optimally to the respective cooling requirements. Especially in the case of low to medium loading of the hydraulic system, power can be saved by the operation of a second and third fan which are smaller in size in comparison to the first fan. It is also possible to operate even only the second or the third fan depending on the requirements. The second and third fan are preferably also controlled by the control device, which also controls the first fan, although a separate control of the first fan with a separate control device is also possible.

It is frequently advantageous to cool further components of the ground milling machine via at least one further cooling circuit in addition to the cooling of the internal combustion engine and the hydraulic system. Cooling devices for cooling the milling gear and/or pump transfer gear, etc., can be provided, for example. It is ideal if said additional cooling devices are structurally integrated in the first and/or second cooling air duct in order to keep additional costs for construction work as low as possible.

Accordingly, it is preferable, for example, to arrange an additional heat exchanger in the first cooling air duct of the engine air cooling device, which additional heat exchanger is connected to a cooling circuit for cooling the milling gear, wherein the additional heat exchanger is arranged adjacent to the engine heat exchanger, and especially above said heat exchanger. A cooling liquid thus flows through the additional heat exchanger, which is used for cooling the milling gear with which drive power is transferred from the internal combustion engine to the milling drum. The additional heat exchanger is arranged adjacent to and especially above the engine heat exchanger in such a way that the cooling air of the first cooling air duct also flows through the additional heat exchanger. The arrangement of the engine heat exchanger and the additional heat exchanger as well as the first cooling air duct is preferably made in such a way that cooling air either flows through the engine heat exchanger or the additional heat exchanger, but not through both heat exchangers. It is thus ensured that "fresh" cooling air always flows through the respective heat exchanger and thus provides for maximum removal of heat from the respective heat exchanger. The arrangement of the additional heat exchanger adjacent to and especially above the engine heat exchanger also ensures that the two heat exchangers are pre-mounted outside of the ground milling machine, for example, which facilitates mounting.

It is additionally, or alternatively, preferable that an additional heat exchanger is present in the second cooling air duct of the hydraulic fluid cooling device, which additional heat exchanger is connected to a cooling circuit for cooling the pump transfer gear, wherein the additional heat exchanger is arranged adjacent to and especially above the hydraulic fluid heat exchanger. The statements made above concerning the heat exchanger additionally arranged in the engine cooling device apply similarly to said additional heat exchanger which is arranged in the second cooling air duct. A cooling liquid of a cooling circuit for cooling the pump transfer gear flows through the additional heat exchanger of the hydraulic fluid cooling device and ensures that it is sufficiently cooled. The cooling air which flows through the additional heat exchanger is conveyed by the second and optionally the third fan. Mounting of the ground milling machine is again promoted by joint installation of a pre-mounted unit of the hydraulic fluid heat exchanger and the additional heat exchanger.

An embodiment has proved to be especially preferred with respect to mounting and maintenance work of the cooling system on the ground milling machine in which a common retaining frame is present, on which the engine cooling device and the hydraulic fluid cooling device, and especially also the first separating wall and/or the second separating wall, are mounted. A retaining frame designates a contiguous, particularly frame-like support structure on which the respective aforementioned components are fixed and retained. The retaining frame can either be arranged firstly in the ground milling machine and then comprise receivers for the individual components of the cooling system, or it can also be pre-mounted outside of the ground milling machine with the respective components of the cooling system and subsequently be installed as a modular unit or a contiguous cooling assembly in the ground milling machine. The retaining frame is implemented in its entirety for accommodating at least two of the components of engine heat exchanger, first fan, parts of the cooling circuit for the cooling liquid of the internal combustion engine, hydraulic fluid heat exchanger, second and/or third fan, first separating wall, second separating wall, internal combustion engine, heat exchanger for the milling drum gear, heat exchanger for the pump transfer gear, and further components or boundaries of the first and/or second cooling air duct. The retaining frame can also be a part of the boundary of the engine compartment or the enclosure of the internal combustion engine as well as a part of the first and second cooling air duct which also conducts cooling air at least in sections.

The upper side of the ground milling machine, especially in a region which is situated in the working direction behind the operator platform arranged on the ground milling machine, has proven to be an especially suitable location for arranging at least one air intake opening on the ground milling machine, via which air is aspirated from the ambient environment and is supplied directly or indirectly to the first and the second cooling air duct. Less dust is aspirated in this location, which would have a negative effect on the components of the cooling system. The air intake opening thus connects the ambient environment to the first and/or second cooling air duct. On the one hand, a common air intake opening can be present for the first and the second cooling air duct. On the other hand, one or several separate air intake openings can also respectively be provided for the first and the second cooling air duct, through which cooling air only flows into the respective first and/or second cooling air duct.

In the case of passage openings being provided between the engine compartment and the second cooling air duct, the size of the air intake opening to the second cooling air duct can have a direct influence on the quantity of engine air that is conveyed out of the engine compartment. If the suction produced by the second or third fan is kept constant in the second cooling air duct and the permeability of the air intake opening to the second cooling air duct is reduced, more engine air will be aspirated and removed from the engine compartment into the second cooling air duct. If the air intake opening is enlarged, on the other hand, the rate of the volumetric flow from the ambient environment into the second cooling air duct increases and less engine air is extracted by suction from the engine compartment into the second cooling air duct. The air intake opening is therefore provided in a preferred embodiment with a device via which the opening cross-section or the size of the opening area transversely to the direction of flow of the cooling air is adjustable at least within a limited range. Provision may, however, additionally or alternatively, also be made for the size and/or the number of the at least one passage opening between the engine compartment and the second cooling air duct to be implemented as variable, specifically, for example, the total opening cross-section of all provided passage openings in this region. If the passage openings are enlarged, more air can flow from the engine compartment to the second cooling air duct or vice versa, depending on the specific embodiment of the cooling system. It is therefore preferred that at least one device is present which is arranged in such a way that it can increase or decrease the size of the total opening cross-section of the at least one passage opening. This can be an aperture or an adjustable closure flap, wherein the adjustment within the adjusting range is ideally possible in a continuously variable manner. As a result of the two refinements, the volume flow through the air intake opening to the second cooling air duct and/or the at least one passage opening between the engine compartment and the second cooling air duct can be adjusted and ideally controlled, so that an especially efficient engine compartment ventilation is also achieved in particular. The closed-loop control of the engine compartment ventilation by the closure element preferably also occurs, for example, by a control device which uses the temperature in the engine compartment of the internal combustion engine as a closed-loop control variable in an alternative embodiment.

After passage of the first and/or second cooling air duct, the cooling air exits the ground milling machine via at least one air discharge opening, wherein a common air discharge opening for the cooling air exiting from the first and the second cooling air duct can also be provided. In order to provide especially easy accessibility for components of the cooling system for maintenance work, for example, it is preferable if the first and the second cooling air outlet open into a common air discharge space, which comprises on its part the at least one air discharge opening to the ambient environment. The common air discharge space is, for example, arranged, as regarded in the direction of flow of the cooling air, directly behind the first and the second fan if said fans form the end of the first and the second cooling air duct. The first and the second cooling air outlet then designate the location where the cooling air is ejected from the respective fans. The cooling air from the first cooling air duct and the second cooling air duct can mix in the direction of flow of the cooling air behind the fans; a further separation of the cooling air flows is no longer necessary from this point. It is still obviously possible to form the air discharge space for only one of the cooling air flows from the first and the second cooling air duct, and to separate the same by a common separating wall, for example. A comparatively large air discharge space is, however, created by omitting said separating wall, which allows for maintenance work to be carried out on the fans.

Both the raising of dust and also hot air from the air discharge opening of the ground milling machine can be unpleasant for the driver of the ground milling machine and for bystanders. In order to avoid these impairments, it is preferred that the at least one air discharge opening of the first and/or the second cooling air outlet is arranged in the rear of the ground milling machine, and the air discharge space and/or the at least one air discharge opening comprises an air guide device which is arranged in such a way that it conducts the exhaust air in the working direction to the rear and in an upwardly inclined manner to the ambient environment. In other words, the exhaust air of the cooling system is conducted away from the operator platform and also from the ground and from persons that may be situated close to the ground milling machine. The conduction in the working direction to the rear and in an upwardly inclined manner has proven to be especially advantageous. An air guide device is provided for this purpose either on the air discharge space or on the air discharge opening or on both, from which the exhaust air is conducted in this direction. The air guide device can consist of one or several guide plates which discharge the air flow of the discharge air upwardly in an inclined manner.

The arrangement of the fans can also vary. Fans with hydraulic or electric drives can be used, for example.

The object of the present invention is also achieved by a cooling system for a ground milling machine, especially a cold milling machine, a recycler or a stabiliser, according to the previous statements. As already mentioned, the cooling system can be arranged in a modular manner in such a way that at least two or even all components of the cooling system can be mounted jointly as a module on the ground milling machine. Reference is hereby made to the previous statements with respect to further details on the configuration and functionality of the cooling system.

Finally, the object of the present invention is also achieved according to the present invention by a method for cooling an internal combustion engine arranged in an engine compartment and a hydraulic system of a ground milling machine, especially a cold milling machine, a stabiliser or a recycler, especially by using the cooling system as described above. All previously described features of the cooling system and the ground milling machine having said cooling system can thus also be applied to the method, and conversely the method is especially suitable for implementation in a ground milling machine, especially a cold milling machine, a stabiliser or a recycler, as described above.

It is a first element of the method according to the present invention that, parallel to the steps which are known from the prior art and occur in the first cooling air duct, an extraction of cooling air by suction into a second cooling air duct occurs simultaneously by a second fan, followed by conduction of the cooling air of the second cooling air duct through a hydraulic fluid cooling device with a hydraulic fluid heat exchanger and an ejection of the cooling air via the duct outlet of the second cooling air duct. In addition to the first cooling air duct, which comprises the aforementioned components as described above, the operation of a second cooling air duct is provided which is independent therefrom, the first cooling air duct comprising the engine heat exchanger and the second cooling air duct comprising the hydraulic fluid heat exchanger. Different cooling air thus flows through the two heat exchangers separately from each other. This occurs specifically by conduction of the cooling air of the second cooling air duct through the hydraulic fluid cooling device which is spatially separated from the conduction of cooling air of the first cooling air duct through the engine cooling device. This allows a substantially more efficient performance of the cooling process of the two heat exchangers. It is a further essential method step that the cooling air of the first cooling air duct and the cooling air of the second cooling air duct is conducted through the respective cooling air duct and also through the ground milling machine per se circumventing the engine compartment. As already mentioned above, mutually spatially separated compartments are created by the first cooling air duct and the second cooling air duct, between which no air exchange occurs in the region of the cooling air ducts. By circumventing the engine compartment, the engine heat exchanger and the hydraulic fluid heat exchanger are continuously supplied with "fresh" cooling air which has not been preheated by the internal combustion engine, for example, so that in the end the cooling power which is achieved by the cooling air moved past the respective heat exchanger is increased.

The cooling air within the first cooling air duct is preferably either guided through the engine heat exchanger or through an additional heat exchanger which is connected to a cooling circuit for cooling the milling gear. As a result, two heat exchangers are thus supplied with cooling air in a cooling air duct in parallel and not successively in the direction of flow. It is further also preferred that the cooling air of the second cooling air duct in the hydraulic fluid cooling device is either conducted through the hydraulic fluid heat exchanger or through an additional heat exchanger which is connected to a cooling circuit for cooling the pump transfer gear. The cooling air is respectively conducted through the first and second cooling air duct, respectively, in such a way that it only flows through one heat exchanger and exhaust heat is removed therefrom. A maximum temperature difference is thus achieved between the cooling air reaching the heat exchangers and the heat exchangers, which contributes to especially efficient cooling.

In order to increase the energy efficiency, it is preferred that the respective volumetric flows of the aspirated cooling air of the first and the second cooling air duct are controlled independently from each other via the first and the second fan. The closed-loop control variable which is detected by a control device and used for controlling the first and the second fan is preferably, for example, the temperature of the cooling liquid of the cooling circuit for the internal combustion engine and the temperature of the hydraulic oil of the hydraulic system or also the engine compartment temperature. As a result of the separate closed-loop control of the volumetric flows, the different loading of the internal combustion engine and the hydraulic system in working operation and in travelling operation of the ground milling machine can be taken into account. In particular, the first fan is operated in working operation of the ground milling machine substantially under full load or at maximum speed, whereas the second fan is operated in travelling operation of the ground milling machine substantially under full load or at maximum speed. The loading or the control of the fans thus usually occurs in such a way that they are alternatively or oppositely loaded to a lesser or greater extent with respect to each other, or their speeds are controlled in opposite directions with respect to each other, both fan, however, being controlled individually and independently of each other, and the contra effect thus being rather a result of the loading profile of the ground milling machine in working and transport operation.

It is advantageous for supporting the engine cooling device by the hydraulic fluid cooling device if the engine air from the separate engine compartment is co-extracted by suction into the second cooling air duct through passage openings in the first separating wall delimiting the engine compartment. This is achieved in an especially efficient manner if the volumetric flow of the engine air extracted by suction into the second cooling air duct is controlled as required via one or several suitable closure elements at the at least one provided passage opening. This closed-loop control is preferably also carried out by the control device depending on the temperature of the cooling liquid of the cooling circuit for the internal combustion engine.

Further already described advantages are obtained if the cooling air is extracted by suction into the first and the second cooling air duct on the upper side of the ground milling machine, especially in the working direction behind the operator platform. In this manner, the operator platform is prevented from being heated up by heated exhaust air.

It is similarly preferred if the cooling air is ejected at the rear of the ground milling machine in the working direction to the rear and especially in an upwardly inclined manner. The air is thus ejected away from the operator platform of the ground milling machine, and also from the ground and any potential bystanders.

The method according to the present invention is especially suitable for use in a ground milling machine according to the present invention as already described above, especially in a cold milling machine, a recycler or a stabiliser. Reference is thus especially also made to the disclosure concerning the ground milling machine according to the present invention with respect to the details of the ground milling machine preferably used in the method according to the present invention.

BRIEF DESCRIPTION OF THE DRAWINGS

The present invention will be explained below in closer detail by reference to exemplary embodiments shown in the drawings. In the schematic Figures.

DETAILED DESCRIPTION OF THE INVENTION

Figure 1A:
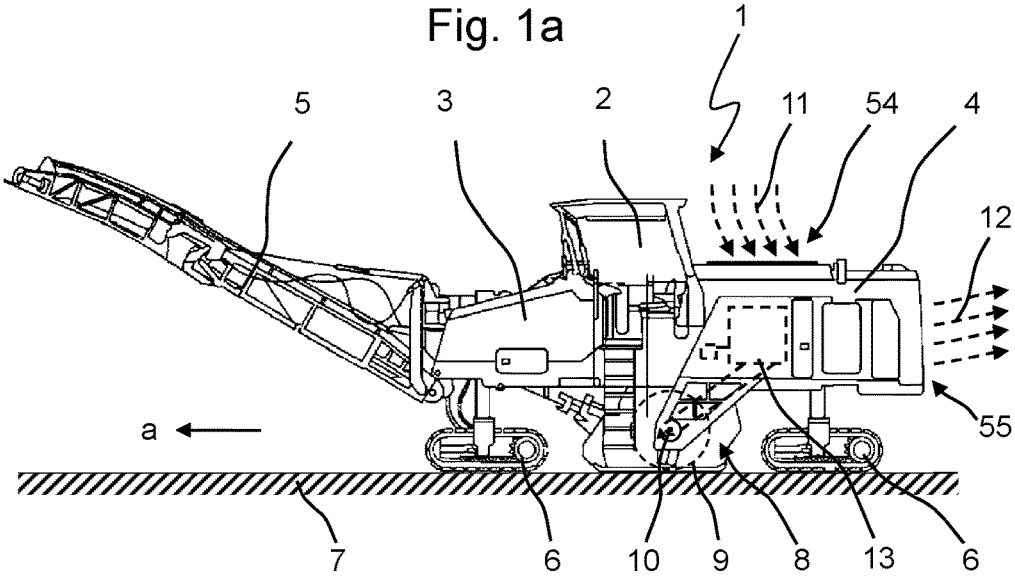
FIG. 1*a* shows a side view of a ground milling machine, specifically a road cold milling machine.

Like components are provided with like reference numerals. Repeated components are partly not designated individually in each drawing.

FIG. 1*a* shows a ground milling machine 1 of the type of a road cold milling machine (center rotor milling machine), comprising an operator platform 2 and a machine frame or chassis 3. The ground milling machine 1 moves in the working direction a over the ground 7 to be processed by using the running gears 6. The ground milling machine 1 mills the ground 7 by means of a milling drum 9 which is mounted in a milling drum box 8 so as to rotate about the rotational axis 10. The removed milling material can be transferred in the working direction a via a discharge device 5, e.g., a discharge conveyor in a pivotable discharge arm, to a transport vehicle not shown here, and can be removed by said vehicle. The ground milling machine 1 further comprises a drive train 13 which is shown in closer detail in FIG. 2*a* or 2*b*. In order to cool components of said drive train 13, a cooling air supply is provided as a part of a cooling system among other things, which cooling air supply is implemented in such a manner that intake air 11 is sucked in on the upper side of the ground milling machine 1 via air intake openings 54 in the region 4 of the ground milling machine 1 situated in the working direction a behind the operator platform 2. The exhaust air 12 is ejected via the air discharge openings 55 in the rear of the ground milling machine 1 against the working direction a to the rear in an upwardly inclined manner (for example, by means of respective guide blades in the outlet region). The design of the region situated between the air intake opening 54 and the air discharge opening 55 will be explained below in closer detail.

Figure 1B:
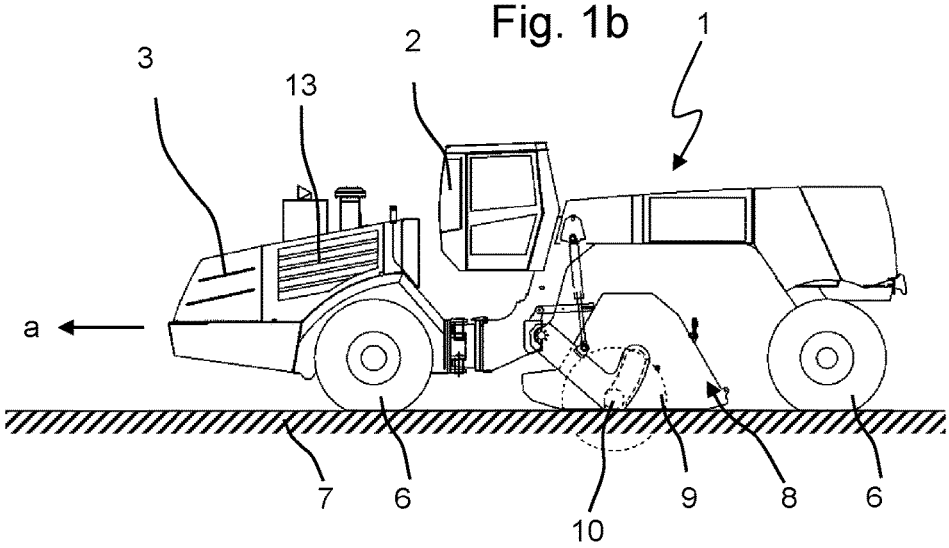
FIG. 1*b* shows a side view of a ground milling machine, specifically a stabiliser/recycler.

An alternative ground milling machine 1 is shown in FIG. 1*b*, which shows a stabiliser/recycler. The ground material is milled in these ground milling machines, however, as opposed to road cold milling machines, this material is not removed but crushed and/or mixed with additives. The essential elements such as the operator platform 2, the machine frame or chassis 3, the running gears 6, a milling drum 9 mounted in a milling box (cover) 8, and the drive train 13 are also present in these ground milling machines. Reference is thus made in these respects to the aforementioned disclosure.

Figure 2A:
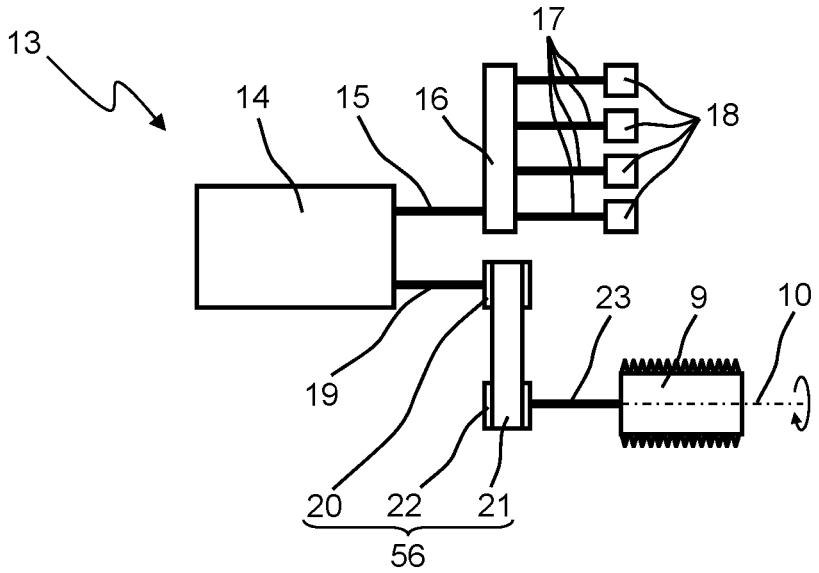
FIG. 2*a* shows a drive train of the ground milling machine of FIG. 1*a;*

An exemplary drive train 13 of the ground milling machine 1, especially for a cold milling machine, is shown in a roughly schematic view in FIG. 2*a*. It comprises an internal combustion engine 14 such as a diesel engine, which is connected via a first shaft 15 to a pump transfer gear 16. The pump transfer gear 16 comprises several distributor shafts 17, via which multiple units 18 are driven, especially at least one hydraulic pump of a hydraulic system. The hydraulic system 18 is implemented in such a manner, for example, that hydraulic motors are driven via hydraulic pumps, which hydraulic motors are used for the travel drive of the running gears 6 of the ground milling machine 1. All required hydraulic pumps of the ground milling machine 1 can be coupled to the pump transfer gear 16 and can be supplied by said gear with power. A drive shaft 19 is further provided, via which a milling drum gear 56 can be driven, which will be explained below in closer detail.

A milling gear 56 is further driven by means of the internal combustion engine 14, which in the specific embodiment comprises a drive pulley 20, a driven pulley 22 and a traction means 21 as a part of a belt drive in the manner known in the prior art. The drive pulley 20 transmits said power via the traction means 21 to the driven pulley 22, and from said pulley to a drum shaft 23. The drum shaft 23 drives the milling drum 9, usually via a respective reduction gear, which is not shown here, in working operation of the ground milling machine 1 for rotation about the rotational axis 10.

In working operation of the ground milling machine 1, i.e., while the milling drum 9 mills ground material from the ground 7 during its rotation, the internal combustion engine 14 runs at a comparatively high speed over a longer period of time. A large amount of heat is thus developed by the internal combustion engine 14 in this operating stage. In travelling operation of the ground milling machine 1, i.e., when the milling drum 9 is idle and the running gears 6 are driven via the hydraulic system 18, the internal combustion engine 14 is loaded to a considerably lesser extent and runs in this operating range with comparatively low power. The heat development is accordingly low. In contrast, the hydraulic system 18 is heavily loaded in travelling operation of the ground milling machine 1 with respect to the operation of the hydraulic pumps for driving the respective hydraulic driving motors on the running gears 6. The hydraulic oil of the hydraulic system 18 thus heats up very strongly. This effect in turn occurs to a substantially lesser extent in working operation because the travelling speed of the ground milling machine 1 is then comparatively low. In order to achieve an energy-efficient cooling of the components of the ground milling machine 1, especially with respect to the cooling of the internal combustion engine and the hydraulic system, the present invention proposes a cooling system which enables in working operation mainly a cooling of the internal combustion engine 14 via a cooling circuit with cooling liquid which is connected thereto, and which in travelling operation of the ground milling machine 1 mainly allows effective cooling of the hydraulic oil of the hydraulic system 18 or at least parts thereof. Details of such a cooling system will be explained below in closer detail.

Figure 2B:
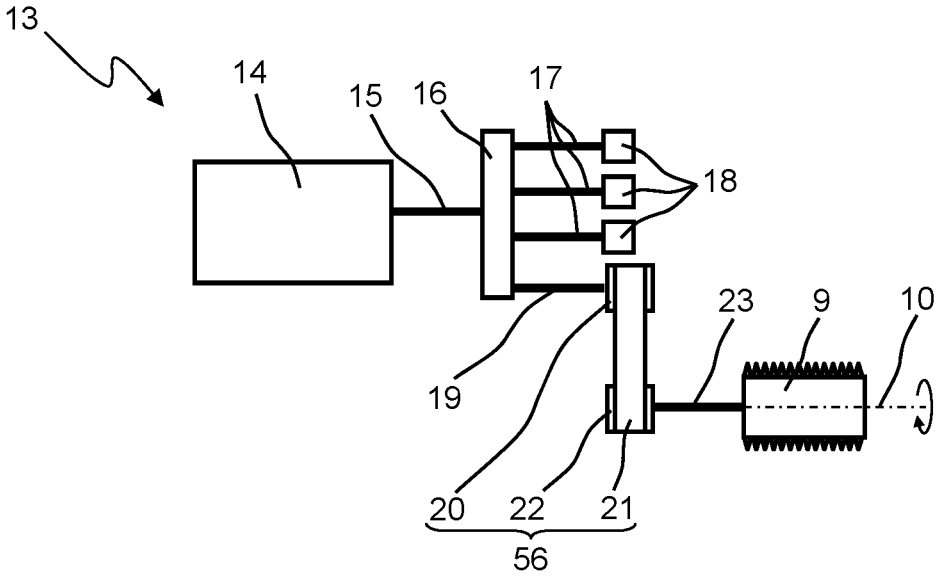
FIG. 2*b* shows an alternative drive train of the ground milling machine of FIG. 1*a;*

FIG. 2*b* shows an alternative embodiment of the drive train 13, reference being hereby made to the preceding statements with respect to FIG. 2*a* concerning the general configuration. The essential difference here is that the connection of the milling drum gear or the shaft 19 occurs via the pump transfer gear. A shiftable clutch (not shown in closer detail in FIG. 2*b*) can further be provided at this point (between the pump transfer gear 16 and the drive pulley 20).

Figure 3:
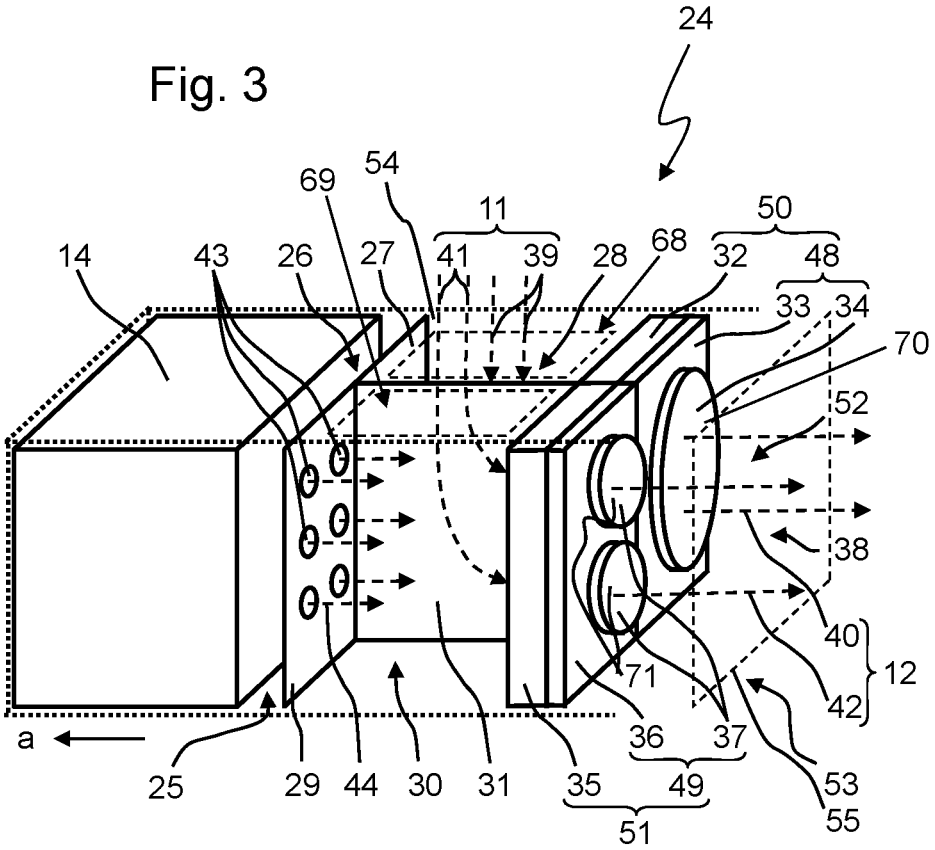
FIG. 3 shows a perspective side view of a first embodiment of a cooling system of a ground milling machine.
Figure 4:
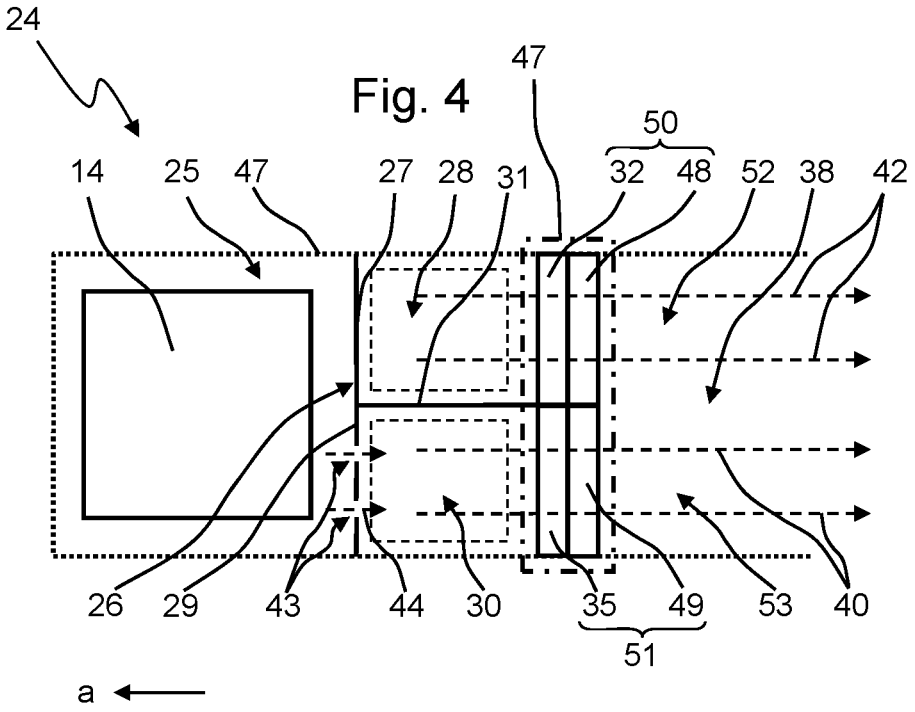
FIG. 4 shows a top view of the cooling system according to FIG. 3.

A first embodiment of a cooling system 24 is shown in closer detail in FIGS. 3 and 4. The intake air 11 flows from above through the air intake opening 54 into the cooling system 24. The aspirated intake air flows proportionally either into a first cooling air duct 28 or into a second cooling air duct 30. The intake air 11 is thus divided into two air flows, which are conducted separately from each other either through the first cooling air duct 28 or the second cooling air duct 30. The first cooling air duct 28 conducts the cooling air 39 to the engine cooling device 50, which comprises the engine heat exchanger 32, the engine fan device 48 and a cooling circuit, which is not shown, with cooling liquid for the internal combustion engine 14. The cooling circuit for the internal combustion engine 14 is in fluidic connection with the engine heat exchanger 32. The second cooling air duct 30, on the other hand, conducts cooling air 41 separately from the cooling air 39 to the hydraulic fluid cooling device 51, which comprises the hydraulic fluid heat exchanger 35 and the hydraulic fan device 49. In the direction of flow of the cooling air 39, 41 behind the fan devices 48, 49, the two exhaust air flows 40, 42 of the engine cooling device 50 and the hydraulic fluid cooling device 51 are conducted together as exhaust air 12 back to the ambient environment of the ground milling machine 1. In the direction of flow of the cooling air, the first cooling air duct 28 extends from a duct inlet 68, via which the intake air is extracted by suction from above, to a duct outlet 70, which in the present embodiment corresponds to the outflow side of a first fan 34. The cooling air flows through the engine heat exchanger 32 between the duct inlet and the duct outlet, and/or, depending on the embodiment, through at least one supplementary heat exchanger arranged in the first cooling air duct 28. Correspondingly, the second cooling air duct 30 extends in the direction of flow of the cooling air from a duct inlet 69, via which the intake air 11 is extracted by suction from above, to a duct outlet 71, which in the present embodiment corresponds to the outflow side of a second fan 37 (in the present embodiment the second and third fan). The cooling air flows through the hydraulic fluid heat exchanger 35 between the duct inlet and the duct outlet, and/or, depending on the embodiment, at least one supplementary heat exchanger arranged in the second cooling air duct 30. The cooling air ducts 28 and 30 are thus defined by a mutually separate cooling air inlet, the mutually separate guidance of the cooling air, the arrangement of at least one respective heat exchanger and the at least one fan within the duct, and one respective cooling air outlet after the passage of the heat exchanger and the fan (in this sequence or in reverse sequence).

The flow of the cooling air from the air intake openings 54 to the air discharge openings 55 is produced and maintained by the engine fan device 48 and the hydraulic fan device 49. The engine fan device 48 comprises a first fan cover or hood 33 in the direction of flow to the rear and an upstream first fan 34. The hydraulic fan device 49 correspondingly comprises a second fan cover or hood 36 and, in the shown embodiment, a second and third fan 37. The hoods 33 and 36 are used for channelling the path of flow of the cooling air 39, 41 and for ensuring that substantially the entire cooling air is sucked through the fans 34, 37. The fans 34, 37 allow the suction of cooling air from the ambient environment and the production and maintaining of the cooling air flow through the cooling air ducts. The first and the second cooling air ducts 28, 30 lie on the suction side of the fans 34, 37. From the suction side of the fans 34, 37, the air is conveyed in the direction of flow to the pressure side, on which a first cooling air outlet 52 adjoins the first duct outlet 70 and a second cooling air outlet 53 adjoins the second duct outlet 71 directly after the fans 34, 37. The two cooling air outlets 52, 53 are not separate from each other in the illustrated embodiment and jointly form a common exhaust air space 38. The exhaust air 12 flows through the exhaust air space 38 until it exits at the air discharge openings 55 from the ground milling machine 1 to the ambient environment. The first and the second cooling air ducts are further lined towards their duct sides with respective side walls, for example, to the base and to the sides, except for the regions of the "duct inlet 68 and 69" and "duct outlet 70 and 71", in order to enable a channelled guidance of cooling air along the longitudinal extension of the first and the second cooling air duct.

The fans 34, 37 are, for example, fans with a fan wheel which comprises multiple blades arranged radially around the rotational axis of the fan wheel, which blades cause the air to move upon rotation of the fan wheel and produce the air flow from the suction to the pressure side of the fans 34, 37. The fans 34, 37 can be driven hydraulically or electrically.

The first cooling air duct 28 and the second cooling air duct 30 lie directly adjacent to the engine compartment 25 in which the internal combustion engine 14 is arranged, or behind said compartment in the working direction a. They are spatially separated therefrom by a first separating wall 26, so that the intake air 11 which is conveyed in the direction of the fan devices 48, 49 circumvents the engine compartment 25. The first and the second cooling air duct 28, 30 are also arranged adjacent to each other and separated from each other by the second separating wall 31. The further side walls of the first and second cooling air duct 28, 30 are only shown transparently and in dots in FIGS. 3 and 4 for reasons of clarity of the illustration.

A retaining frame 47 (indicated with the dot-dash line in FIG. 4) is further provided. The retaining frame 47 is a support structure which especially retains the fans 34, 37 and connects said fans to a machine frame of the ground milling machine 1. Essential elements of the first cooling air duct 28 and the second cooling air duct 30 can be premounted on the retaining frame 47 in form of a "cooling assembly" and can be subsequently installed as a unit in the ground milling machine 1. This facilitates mounting considerably.

Figure 5:
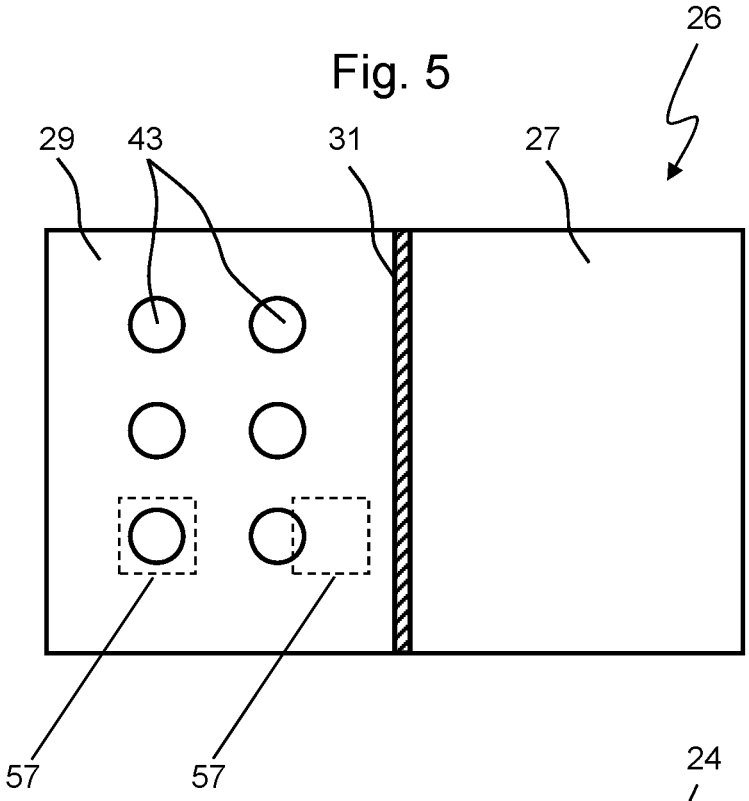
FIG. 5 shows a first separating wall.

The first separating wall 26 shown in FIGS. 3 and 4 is also shown in detail in FIG. 5 in a top view against the direction of flow and in the direction of view as seen from the side of the heat exchangers 32, 35. The engine therefore lies into the sheet plane behind the first separating wall 26, whereas parts of the first and the second cooling air duct 28, 30 are situated out of the sheet plane before the separating wall 26. The first separating wall 26 is divided by the second separating wall 31 into an engine cooler side 27 and a hydraulic cooler side 29, the engine cooler side 27 being the portion of the first separating wall 26 which separates the first cooling air duct 28 from the engine compartment 25. The hydraulic cooler side 29 of the first separating wall 26, on the other hand, is the portion of the first separating wall 26 which separates the second cooling air duct 30 from the engine compartment 25. In the illustrated embodiment, a total of six passage openings 43 are provided in the hydraulic cooler side 29 of the first separating wall 26, which passage openings connect the engine compartment 25 to the air space of the second cooling air duct 30. In the space of the second cooling air duct 30 which is situated before the second and third fan 37, i.e., on the suction side of the second and third fan 37 of the hydraulic fluid cooling device 51, a vacuum is present in the second cooling air duct 30. This leads to the consequence that engine air 44 (i.e., air surrounding the internal combustion engine in the engine compartment) is extracted by suction through the passage openings 43 in the first separating wall 26 and reaches the second cooling air duct 30 and mixes there with the cooling air 11. The engine air 44 is conveyed from the second cooling air duct 30 together with the cooling air 41 of the hydraulic fluid cooling device 51 through the fan 37 into the exhaust air space 38. Efficient engine compartment ventilation is produced by removing the engine air 44 from the engine compartment 25. This is especially advantageous if the engine cooling device 50 is already operated at maximum power, for example, in travelling operation. Since, in this case, the cooling demand of the hydraulic fluid cooling device is comparatively low for the reasons mentioned above, the slight heating of the cooling air produced by the admixed engine air is not disadvantageous.

FIG. 5 further illustrates an optional refinement, which enables a regulation of the opening area of the passage openings 43. A broad spectrum of potential alternatives can be used in this case, wherein it is essential that the flowable opening area of one or several passage openings 43 is adjustable via an adjusting movement. Apertures, closure flaps or even slides 57 can specifically be used in this case, for example, as is shown in FIG. 5, by way of example, at the two bottom passage openings 43. The left slide is in a position in which the passage opening 43 is closed and, therefore, an exchange of air through the passage opening is completely prevented. The right passage opening 43, on the other hand, is already nearly completely opened by the slide 57. Provision may be made, in this case, for example, for an actuating element not designated here in closer detail, for example, a motor or the like, via which the adjustment of the slide position can be automated. It is understood that manual adjustment is also possible. The passage openings 43 are dimensioned with respect to their size and number in such a way that both efficient cooling of the internal combustion engine 14 is ensured by the removal of the engine air 44, and also that sufficient "fresh" cooling air 41 is moved past the hydraulic fluid heat exchanger 35 in order to ensure efficient cooling of the hydraulic oil of the hydraulic system 18.

Figure 7:
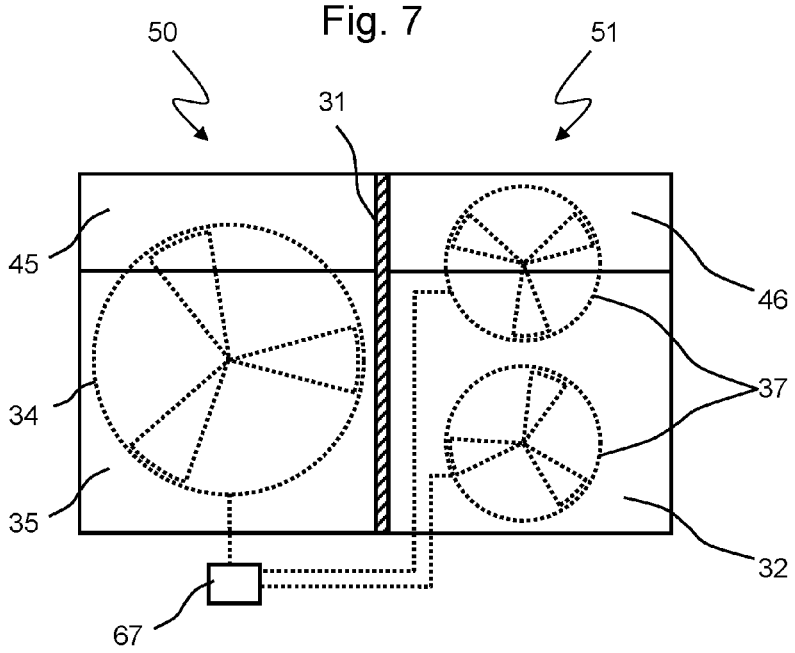
FIG. 7 shows a heat exchanger and a fan of the cooling system according to FIG. 6.

The first fan 34 and the second and third fan 37 can be triggered and also controlled independently from each other as required by a control device 67 (FIG. 7). Said control device 67 controls the volumetric flow via the respective fans 34, 37 on the basis of the temperature of the cooling liquid of the cooling circuit of the internal combustion engine 14 or the hydraulic oil of the hydraulic system 18. Suitable temperature sensors are provided for this purpose. If the demand for the cooling air flow increases in the case of rising temperatures, the control device will raise the fan speed and vice versa. This ensures that the fan speed always is in the optimal range. It is further important here that the fans 34, 37 are all controllable by the control device 67 independently of each other. If the need for cooling only increases at the engine heat exchanger 32, the control device 67 will only turn up the first fan 34. This ensures individual fan control for the first and the second cooling air duct.

Figure 6:
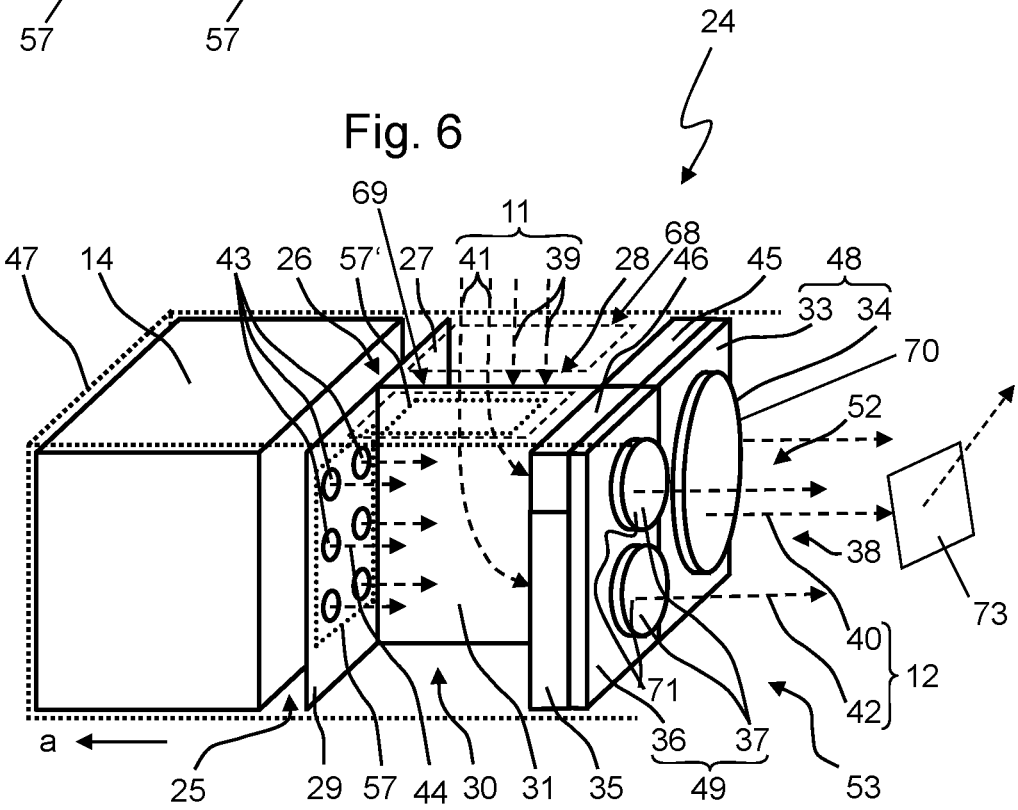
FIG. 6 shows a perspective side view of a further embodiment of a cooling system of a ground milling machine.

FIGS. 6 and 7 show a further embodiment of the cooling system 24. As in the preceding embodiment, the fans 34, 37 are all controlled independently of each other by the control device 67. In contrast to the embodiment of FIGS. 3 and 4, the cooling system 24 of FIG. 6 comprises in addition to the engine heat exchanger 34 an additional heat exchanger 45 which is arranged directly above the heat exchanger 32. A cooling liquid flows through the heat exchanger 45, which cooling liquid is part of a cooling system for cooling the milling gear 56. The heat exchanger 45 is arranged in such a way that "fresh" cooling air 39 flows through said heat exchanger, which cooling air has not yet passed any further heat exchanger and which is extracted by suction by the first fan 34 from the first cooling air duct 28. In order to achieve this, the heat exchanger 45 is also located before the first hood 33 of the engine fan device 48 in the direction of flow of the cooling air 39. The exhaust air of the heat exchanger 45 therefore flows together with the exhaust air of the engine heat exchanger 32 into the common exhaust air space 38. The volumetric flow required for this purpose is generated by the first fan 34. The arrangement of the heat exchanger 45 for cooling the milling gear 56 directly adjacent to and especially above the engine heat exchanger 35, without the heat exchanger 45 and the engine heat exchanger 35 overlapping each other, is also shown in FIG. 7, which shows a view of the engine cooling device 50 and the hydraulic fluid cooling device 51 in the direction of flow of the cooling air 39, 41 from the side of the first and the second cooling air duct 28, 30.

The two cooling devices 50, 51 are separated from each other with respect to space and air flow by the second separating wall 31, so that the cooling air 39 from the first cooling air duct 28 only passes through the heat exchangers 35, 45 and the first fan 34, and the cooling air 41 which is separated therefrom passes together with the engine air 44 through the heat exchanger 32, 46 and the second and third fan 37. The mixing of the air from the first of the second cooling air duct 28, 30 only occurs in a common exhaust air space 38, which adjoins the duct outlets 70 and 71 in the direction of flow of the cooling air.

Furthermore, in contrast to the cooling system 24 of FIG. 3, a further heat exchanger 46 is arranged adjacent to, and especially directly above, the hydraulic fluid heat exchanger 35 in the embodiment of the cooling system 24 of FIG. 6. A cooling liquid flows through the further heat exchanger 46, which absorbs the waste heat of the pump transfer gear 16 via a cooling circuit arranged on said gear. A cooling fluid flows around the further heat exchanger 46, which absorbs the exhaust heat of the pump transfer gear 16 via a cooling circuit which is arranged thereon. The further heat exchanger 46 is connected to the second hood 36 in such a way that cooling air 41 of the second cooling air duct 30 is sucked by the second and/or third fan 37 through the further heat exchanger 46, which air previously has not passed any further heat exchanger. This ensures efficient cooling of the pump transfer gear 16 by the further heat exchanger 46. FIG. 7 also shows that the further heat exchanger 46 within the hydraulic fluid cooling device 51 is arranged adjacent to, especially above, the hydraulic fluid heat exchanger 32 in such a way that the heat exchanger 46 does not overlap with the hydraulic fluid heat exchanger 32. The air which is sucked through the second and/or third fan 37 through the further heat exchanger 46 or the hydraulic fluid heat exchanger 35 joins in the common exhaust air space 38 with the cooling air 39 which flows through the engine cooling device 50.

FIG. 6 also shows a further closure element 57', which can seal the second cooling air duct 30 against the air intake openings 54. In contrast to the aforementioned closure element 57 of the passage openings 43, the closure element 57' thus controls the volumetric flow between the ambient environment and the second cooling air duct 30. The access to the second cooling air duct 30 can be sealed by the closure element 57, for example, as a result of which the volumetric flow of the engine air 44 from the engine compartment 25 through the passage openings 43 is increased in combination with the same power of the fans 37. The ventilation of the engine compartment is thus increased with increased volumetric flow through the passage openings 43. The engine air 44 is preheated by the combustion engine 14, so that the cooling efficiency at the hydraulic fluid heat exchanger 35 and the further heat exchanger 46 which cools the pump transfer gear 16 is reduced. However, since these components are loaded to a lesser extent in working operation of the ground milling machine 1, reduced cooling of these components is still adequate. The hydraulic fluid cooling device 51 can thus be used in working operation of the ground milling machine 1 for the support of the engine cooling device 50 for cooling the internal combustion engine 14 without any disadvantage.

Furthermore, a closure element 57 is also present in this embodiment, which is arranged as a pivotable flap which rests on the passage openings 43 so as to close them all, and which can be pivoted away from the openings so as to open them. The closure element 57 can thus vary and also completely prevent a flow of engine air 44 from the engine compartment 25 into the second cooling air duct 30. It is thus possible, in travelling operation of the ground milling machine 1, for example, when the hydraulic system 18 is substantially maximally loaded, to prevent engine compartment ventilation by the passage openings 43 in order to utilise the entire cooling power of the hydraulic fluid cooling device 51 for cooling the hydraulic oil of the hydraulic system 18 and/or the cooling liquid of the pump transfer gear 16 in the additional heat exchanger 46. The provision of the closure elements 57, 57' thus ensures that both in working operation and also in travelling operation of the ground milling machine 1 the components that are respectively loaded to the greatest extent can be cooled efficiently.

FIG. 6 further shows a guide blade 73, which is arranged in the air exit region on the ground milling machine 1, where the cooling air exits the ground milling machine 1 to the ambient environment. The guide blade 73 deflects the cooling air flow to the rear and in an upwardly inclined manner, so that it does not raise dust from the ground when leaving the machine.

Figure 8:
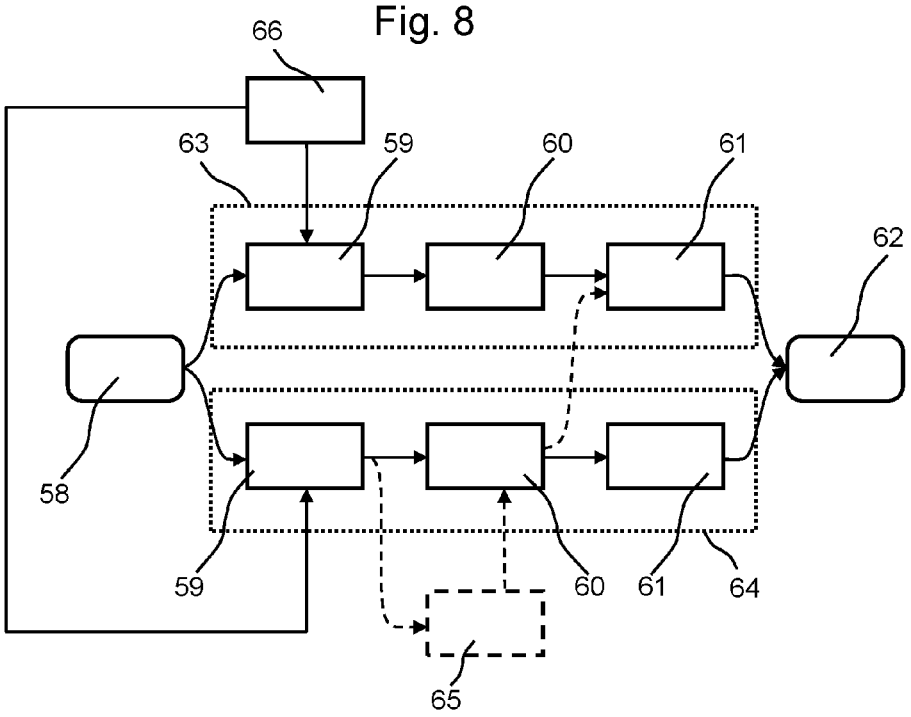
FIG. 8 shows a flowchart of a method according to the present invention.

FIG. 8 finally illustrates the sequence of the method for cooling the internal combustion engine 14 arranged in an engine compartment 25 and the hydraulic system 18 of a ground milling machine 1. The start of the method is designated by reference numeral 58. It is a basic concept that the method is essentially carried out in the spatially separated compartments 63 and 64, which functionally correspond to the first and the second cooling air duct 28, 30. No air can be exchanged between the compartments 63, 64. The respective cooling air flows 39, 41 are thus separated from each other.

The first step in the two compartments 63, 64 is the suction 59 of cooling air from the ambient environment. Said suction of air from the ambient environment is produced by the first fan 34 and a second and/or third fan 37. The volumetric flow of the aspirated air to the two compartments 63, 64 is subject to the control 66 by a control device 67. The control device 67 regulates the volumetric flow of the fans 34, 37 depending on the temperature of the cooling liquid of a cooling circuit for the internal combustion engine 14 or depending on the temperature of the hydraulic oil of the hydraulic system 18.

The suction 59 of the cooling air 39, 41 is followed by the conduction 60 of the cooling air 39, 41 through the engine cooling device 50 and the hydraulic fluid cooling device 51. The cooling air 39 of the first compartment 63 thus either passes a heat exchanger 45 which is connected to a cooling circuit for cooling the milling gear, or the engine heat exchanger 35. In each case, the cooling air 35 then passes the first fan 34. Separated therefrom, the cooling air 41 of the second compartment 64 either passes the heat exchanger 46 which is connected to a cooling circuit for cooling the pump transfer gear 16, or the hydraulic fluid heat exchanger 32. In each case, the cooling air 41 then passes either the second or third fan 37. In the second compartment 64, a suction 65 of engine air 44 from the engine compartment 25 into the second compartment 64 can further occur. The engine air 44 flows in the second compartment 64 together with the cooling air 41 further through the hydraulic fluid cooling device 51 and thence into the exhaust air space 38.

The ejection 61 of the air through the air discharge openings 55 occurs from the exhaust air space 38. The ejection 61 of the air may occur either separately from each other from the different compartments 63 and 64 or, as indicated by the dashed line between the step 60 in the second compartment 64 and step 61 in the first compartment 63, via a common exhaust air space 38 through the air discharge openings 55. The end 62 of the method is thus reached. The individual method steps are performed continuously and simultaneously during the operation of the ground milling machine 1 and are controlled by the control device 67.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A ground milling machine, comprising:

an internal combustion engine arranged in an engine compartment;

a hydraulic system with at least one hydraulic pump and travelling devices which are driven by individual hydraulic motors;

a milling gear driven directly or indirectly by the internal combustion engine, the milling gear comprising a drive pulley, a driven pulley and a traction device as a part of a belt drive;

a cooling system with an engine cooling device and a hydraulic fluid cooling device;

the engine cooling device comprising a first fan and a cooling circuit with an engine heat exchanger;

a first cooling air duct formed such that cooling air aspirated by the first fan from the ambient environment is guided to the engine heat exchanger and subsequently to a first cooling air outlet;

wherein the hydraulic fluid cooling device comprises a second fan and a hydraulic fluid heat exchanger, wherein a second cooling air duct is implemented such that cooling air aspirated from the ambient environment by the second fan is guided to the hydraulic fluid heat exchanger and subsequently to a second cooling air outlet, wherein the first cooling air duct and the second cooling air duct are implemented so as to conduct the cooling air of the first cooling air duct and the cooling air of the second cooling air duct through the engine cooling device and the hydraulic fluid cooling device separately from each other and by circumventing the engine compartment, wherein the ground milling machine is configured to be operated in working operation and in travelling operation, the working operation designating an operating mode in which the ground milling machine travels at a substantially constant first speed and mills the ground surface with a rotating milling drum leading to a first load of the internal combustion engine and a second load of the hydraulic system, with the second load being less than the first load during the working operation, the travelling operation designating an operation mode in which the milling drum is idle and the ground milling machine travels at a second speed which is greater than the first speed leading to a third load of the internal combustion engine and a fourth load of the hydraulic system, with the third load being less than the fourth load during the travelling operation, so that a first heating of a cooling liquid of the internal combustion engine and a second heating of the hydraulic oil of the hydraulic system occurs in working operation, with the first heating being greater than the second heating during the working operation, and a third heating of the cooling liquid of the internal combustion engine and a fourth heating of the hydraulic oil of the hydraulic system occurs in travelling operation, with the third heating being less than the fourth heating during the travelling operation, and wherein the first fan is operated in working operation of the ground milling machine substantially under full load or at maximum speed, whereas the second fan is operated in travelling operation of the ground milling machine substantially under full load or at maximum speed so that the first and the second fans are alternatively or oppositely loaded to a lesser or greater extent with respect to each other, or their speeds are controlled in opposite directions with respect to each other, with the first and second fans being controlled individually and independently of each other.

2. The ground milling machine according to claim 1, wherein the cooling system is implemented such that the engine heat exchanger and the first fan are arranged adjacent to the hydraulic fluid heat exchanger with the second fan.

3. The ground milling machine according to claim 1, wherein the first cooling air duct and the second cooling air duct guide the cooling air aspirated by the respective first and second fan in parallel with respect to each other.

4. The ground milling machine according to claim 1, wherein the first cooling air duct or the second cooling air duct is arranged adjacent to the engine compartment, and is spatially separated from said compartment by a first separating wall.

5. The ground milling machine according to claim 4, wherein the first cooling air duct and the second cooling air duct are arranged directly adjacent to each other and are spatially separated from each other by a second separating wall.

6. The ground milling machine according to claim 5, wherein the second separating wall is arranged perpendicularly and directly adjacent to the first separating wall and is fixed to the first separating wall.

7. The ground milling machine according to claim 4, wherein for venting the engine compartment, at least one passage opening from the engine compartment to the second cooling air duct is provided through which heated engine air can flow from the engine compartment into the second cooling air duct.

8. The ground milling machine according to claim 1, wherein the first fan is arranged in the direction of flow of the cooling air behind the engine heat exchanger, or the second fan is arranged in the direction of flow of the cooling air behind the hydraulic fluid heat exchanger.

9. The ground milling machine according to claim 1, wherein the hydraulic fluid cooling device comprises a third fan in addition to the second fan, the second and third fan being controllable independently of each other.

10. The ground milling machine according to claim 1, wherein an additional heat exchanger is provided in the engine cooling device, which additional heat exchanger is connected to a cooling circuit for cooling the milling gear, the additional heat exchanger being arranged adjacent to the engine heat exchanger.

11. The ground milling machine according to claim 1, wherein an additional heat exchanger is provided in the hydraulic fluid cooling device, which additional heat exchanger is connected to a cooling circuit for cooling a pump transfer gear, the additional heat exchanger being arranged adjacent to the hydraulic fluid heat exchanger.

12. The ground milling machine according to claim 1, wherein a common retaining frame is provided, on which the engine cooling device, the hydraulic fluid cooling device, a first separating wall, and a second separating wall are mounted.

13. The ground milling machine according to claim 1, wherein the ground milling machine comprises at least one air intake opening to the first or second cooling air duct, which is arranged on the upper side of the ground milling machine in the working direction (a) behind an operator platform.

14. The ground milling machine according to claim 7, wherein a closure element is provided, which is implemented so as to be able to control the volumetric flow through the air intake opening to the second cooling air duct or the at least one passage opening between the engine compartment and the second cooling air duct in order to set the level of the engine compartment ventilation as needed.

15. The ground milling machine according to claim 1, wherein the first and second cooling air outlet open into a common exhaust air space, which comprises at least one air discharge opening to the ambient environment.

16. The ground milling machine according to claim 15, wherein the at least one air discharge opening of the first or second cooling air outlet is arranged in the rear of the ground milling machine, and that the exhaust air space or the at least one air discharge opening comprises an air guide device, which is implemented so as to guide the exhaust air in the working direction (a) to the rear and in an upwardly inclined manner to the ambient environment.

17. A cooling system for a ground milling machine according to claim 1.

18. A method for cooling the internal combustion engine arranged in an engine compartment and the hydraulic system of a ground milling machine according to claim 1, comprising the steps:

suction of cooling air into a first cooling air duct by a first fan;

conduction of the cooling air of the first cooling air duct through an engine heat exchanger; and ejection of the cooling air of the first cooling air duct through a cooling air outlet of the first cooling air duct;

wherein aspiration of cooling air into a second cooling air duct by a second fan, conduction of the cooling air of the second cooling air duct through a hydraulic fluid heat exchanger and ejection of the cooling air from the second cooling air duct, wherein a conduction of the cooling air of the second cooling air duct through the hydraulic fluid cooling device occurs spatially separated from the conduction of the cooling air of the first cooling air duct through the engine cooling device, and wherein the cooling air of the first cooling air duct and the cooling air of the second cooling air duct are conducted so as to circumvent the engine compartment.

19. The method according to claim 18, wherein the cooling air of the first cooling air duct is conducted in the engine cooling device either through the engine heat exchanger or through an additional heat exchanger, which is connected to a cooling circuit for cooling the milling gear.

20. The method according to claim 18, wherein the cooling air of the second cooling air duct is conducted in the hydraulic fluid cooling device either through the hydraulic fluid heat exchanger or through an additional heat exchanger which is connected to a cooling circuit for cooling a pump transfer gear.

21. The method according to claim 18, wherein the respective volumetric flows of the aspirated cooling air of the first and second cooling air duct are controlled independently of each other by the first and the second fan.

22. The method according to claim 18, wherein engine air is co-aspirated into the second cooling air duct from the separate engine compartment through passage openings in the first separating wall which delimits the engine compartment.

23. The method according to claim 22, wherein the volumetric flow of the engine air which is co-aspirated into the second cooling air duct is controlled as needed via a closure element.

24. The method according to claim 18, wherein the cooling air is aspirated into the first and the second cooling air duct on the upper side of the ground milling machine in the working direction (a) behind an operator platform.

25. The method according to claim 18, wherein the cooling air is ejected in the rear of the ground milling machine in the working direction (a) to the rear and especially in an upwardly inclined manner.

26. The ground milling machine according to claim 1, wherein the ground milling machine comprises one of a cold milling machine, a stabilizer or a recycler.

27. The ground milling machine according to claim 2, wherein the cooling system is implemented such that the engine heat exchanger and the first fan are arranged adjacent to the hydraulic fluid heat exchanger with the second fan transversely to the working direction (a).

28. The ground milling machine according to claim 4, wherein the first cooling air duct or the second cooling air duct is arranged adjacent to, and in the working direction (a) directly behind, the engine compartment, and is spatially separated from said compartment by a first separating wall.

29. The ground milling machine according to claim 7, wherein the at least one passage opening is provided in a hydraulic cooler side of the first separating wall which delimits the second cooling air duct towards the engine compartment.

30. The ground milling machine according to claim 10, wherein the additional heat exchanger is arranged above the engine heat exchanger.

31. The ground milling machine according to claim 11, wherein the additional heat exchanger is located above the hydraulic fluid heat exchanger.

* * * * *